United States Patent [19]

Ireland

[11] 4,331,853

[45] May 25, 1982

[54] MULTIPLE SWITCH ACTUATING MECHANISM

[76] Inventor: Robert W. Ireland, 138 Clay Dr., Penn Hills, Pa. 15235

[21] Appl. No.: 77,406

[22] Filed: Sep. 20, 1979

Related U.S. Application Data

[63] Continuation of Ser. No. 860,628, Dec. 14, 1977, abandoned.

[51] Int. Cl.[3] ..... H01H 3/04

[52] U.S. Cl. ..... 200/330; 200/332

[58] Field of Search ..... 200/330, 331, 332, 335, 200/336, 337, 338, 340, 153 T, 5 A, 5 E, 17 R, 18

[56] References Cited

U.S. PATENT DOCUMENTS

| | | | |
|---|---|---|---|
| 1,398,580 | 11/1921 | Waite | 200/17 R |
| 1,446,636 | 2/1923 | Bissell | 200/330 |
| 2,389,220 | 11/1945 | Tredeau | 200/331 |
| 2,503,409 | 4/1950 | Platz et al. | 200/332 |
| 2,813,160 | 11/1957 | Tong | 200/18 |
| 2,832,852 | 4/1958 | Andrew | 200/18 |
| 3,081,390 | 3/1963 | Lasar | 200/332 |
| 4,052,578 | 10/1977 | Hoke | 200/18 |

*Primary Examiner*—John W. Shepperd

*Attorney, Agent, or Firm*—Harold A. Williamson

[57] ABSTRACT

The invention provides a multiple switch actuating mechanism for use in combination with a biased open switch unit. The multiple switch actuating mechanism includes an angle shaped member for receiving the biased open switch unit. The angle shaped member has a pivotal means secured thereto. A rocker arm is secured to the pivotal means for oscillatory motion. The rocker arm has first and second rotatably mounted switch contact bearing elements secured to the rocker arm remote from each other. This just described arrangement of rocker arm and rotatably mounted switch contact bearing elements is such that the aforementioned oscillatory motion is transmitted simultaneously to the rotatably mounted switch control bearing means. There is also provided at least one actuating handle for the mechanism and this handle is secured to the rocker arm. The rotatably mounted switch contact bearing elements provide a driving contact with respectively a first and a second biased open switch of the push button type, whereby an oscillatory force applied to the actuating handle causes the oscillatory motion to be transmitted to the first and then to the second biased open switches. This oscillatory motion is converted to unidirectional motion within the push button biased open switches.

5 Claims, 4 Drawing Figures

CONTROLLED UNIT

MULTIPLE SWITCH ACTUATING MECHANISM

Figures 1, 2, 2A, 2B:
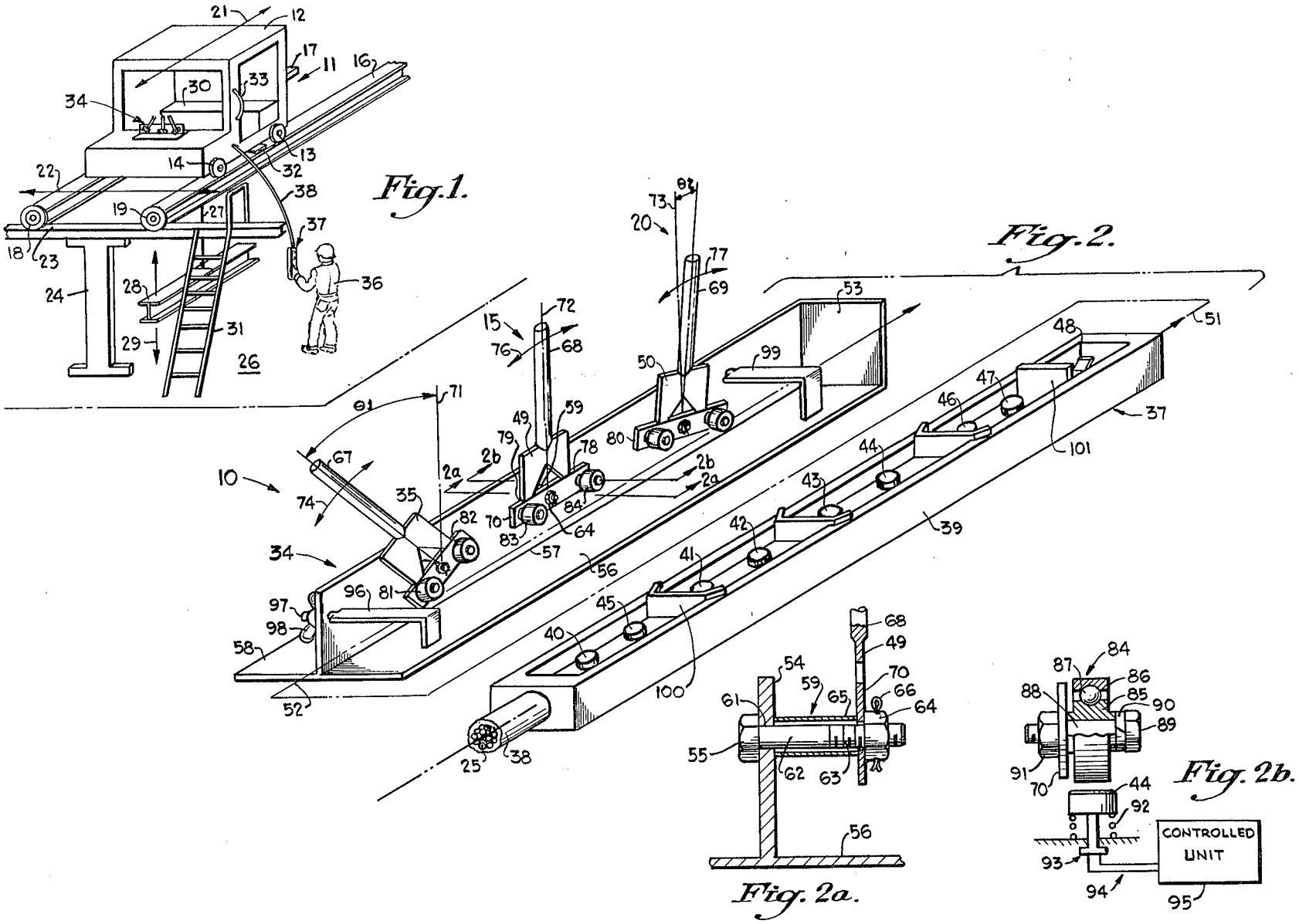

This is a continuation of application Ser. No. 860,628, filed Dec. 14, 1977, now abandoned.

This invention relates to a multiple switch actuating mechanism.

More specifically, this invention relates to a multiple switch actuating mechanism for use in combination with remote control switch units.

The era of increased productivity per worker has led to an ever-increasing need for one man to do the work of two. This has been especially true in the heavy capital goods industry where the original cost of equipment coupled with its long life have precluded the replacement of such equipment with newer, more fully automated equipment.

Industry finding itself with just this type of equipment has sought ways and means to operate this older equipment with fewer men. Just one such example can be found in the steel industry where steel suppliers have fashioned vast storage yards for raw steel and employ for the movement of such steel overhead cranes. These overhead cranes as originally designed call for an operator who rides with the crane. While crane operation over long distances requires an operator physically located in the crane itself, a multitude of small steel moving jobs would be better performed by a crane operator who was stationed on the floor adjacent the steel to be moved. Whenever the crane is being employed to load and unload railroad cars or trucks, it is faster and safer to have the crane operator in the cab.

In order to accomplish these smaller steel moving jobs without the need for a worker on the floor directing the efforts of a crane operator in crane overhead, there has been provided a remote control switch unit connected by flexible cable to the crane's magnetic controllers. The remote control switch unit hangs down from the crane at the end of the flexible cable. This just described arrangement allows a single worker on the floor to reach out and grab the hanging remote control switch and apply pressure to any one of a plurality of resiliently biased open switch buttons. The worker holds the desired biased switch button down until the desired control is accomplished. The control buttons are spring loaded to force an open switch condition whenever the pressure applied by the worker's finger on the button is released. This open switch arrangement is, of course, a safety measure which precludes the crane with its load of steel from getting away from the worker and causing an accident.

Whenever the steel must be moved over some substantial distance, the worker must climb a ladder, enter the crane, and haul up the remote control switch unit. The worker sitting in the crane must then apply pressure to a button and hold the button down during the entire travel of the crane. This often requires the worker to hold down a button for two (2) to five (5) or more minutes. Holding a spring biased button down for more than two minutes may seem like a small task, but it is not as easy as it sounds. Frequently, the worker who is experiencing the fatigue of a day's work finds it difficult to hold the button down continuously. When this occurs, the travel of the crane and its load is jerky and erratic. Multiple unscheduled stops with the jerk of stop and start create a safety hazard in respect of the carried load shifting at the end of the crane's lifting cables.

It is into this environment that the invention to be described provides a unique solution to the problems experienced by the crane operator while he is riding with the crane itself.

It is therefore a primary object of this invention to provide a manual switch actuating mechanism for use with remote control multiple switch units.

Another object of this invention is to provide a remote control switch holding device that has incorporated therein multiple manually operated handles that when operated with an oscillatory motion provide unidirectional movement to actuate normally open, push button, spring biased switches.

In the attainment of the foregoing object the invention provides a multiple switch actuating mechanism for use in combination with a biased open switch unit. The multiple switch actuating mechanism includes an angle shaped member for receiving the biased open switch unit. The angle shaped member has an elongated vertical flat portion and at least one elongated horizontal flat portion integrally secured to the elongated vertical flat portion to thereby form the angle shaped member.

The elongated vertical flat portion has a pivotal means secured to the flat portion at right angles thereto and parallel to the horizontal flat portion. A rocker arm is secured to the pivotal means for oscillatory motion in a plane parallel to the elongated vertical flat portion.

The rocker arm has first and second rotatably mounted switch contact bearing elements secured to the rocker arm remote from each other. This just described arrangement of rocker arm and rotatably mounted switch contact bearing elements is such that the aforementioned oscillatory motion is transmitted simultaneously to the rotatably mounted switch control bearing means. There is also provided at least one actuating handle for the mechanism and this handle is secured to the rocker arm.

The rotatably mounted switch contact bearing elements provide a driving contact with respectively a first and a second biased open switch of the push button type, whereby an oscillatory force applied to the actuating handle causes the oscillatory motion to be transmitted to the first and then to the second biased open switches. This oscillatory motion is converted to unidirectional motion within the push button biased open switches.

In the preferred embodiment there are provided a plurality of actuating handles each secured to a respective rocker arm in a plurality of parallel planes which planes contain the handle and pass respectively through each pivotal means. Each of the handles are secured to the rocker at different angles in respect of the planes that contain the handles and pivotal means.

Other objects and advantages of the present invention will become apparent from the ensuing description and illustrative embodiment thereof, in the course of which reference is made to the accompanying drawings in which:

FIG. 1 illustrates in three dimensional form an industrial setting in which the invention finds its use, and FIG. 2 illustrates the preferred embodiment of the invention, and FIG. 2*a* represents a partial section taken along line 2*a*—2*a* in FIG. 2, and FIG. 2*b* represents a partial section taken along line 2*b*—2*b* of FIG. 2.

Reference is now made to FIG. 1 in which there is depicted in graphic form an industrial setting in which the invention to be described more fully hereinafter finds an ideal environment for its use.

It should be understood at the outset of the description that follows that the arrangement shown in this figure is not intended to depict an actual overhead crane used in industry but more nearly a showing of the various capabilities that such an overhead crane generally possesses. The details of the crane depicted in FIG. 1 do not form a part of the invention. With this understanding in mind, FIG. 1 illustrates a crane assembly 11 which has a cab 12. The cab 12 is mounted on four power driven cab wheels, two of which 13, 14 are shown. These cab wheels 13, 14 are power driven by motors not shown. The cab 12 with its cab wheels 13, 14 travel back and forth on cab guide tracks 16, 17 in the direction of cab movement arrow 21.

The movement of the cab is controlled by an operator 36 standing on the floor 26 via a remote control switch unit 37 and remote control cable 38. The operator 36 is shown with his hand upon the remote control switch unit 37 which unit 37 is shown in greater detail in FIG. 2 and which will be described more fully hereinafter.

The cab 12 contains a seat 30 for the operator, a step 32 and handle 33 which allow the ready entry of the cab 12 by an operator 36 in the manner and for the purposes to be described hereinafter.

The cab guide tracks 16, 17 each are equipped with guide track wheels 18, 19 which are driven by motors not shown in response to the operator 36's actuation of the remote control switch unit 37. The cab guide tracks are secured to each other by means not shown and move in unison to transport the cab guide tracks back and forth in the direction shown by cab guide track movement arrow 22.

In this figure there is shown a single guide wheel support track 23 upon which guide track wheels 18, 19 travel. In actual practice there is at least one more such support track to the rear of the cab 12 which provides support for the rearwardly disposed guide tracks 16, 17. The guide wheel support track 23 is held aloft and supported by column 24.

A ladder 31 secured to guide wheel support track 23 has its lowermost end resting on the floor 26. This ladder 31 provides the means by which the operator 36 can scale the height of the cab assembly 11 and gain access to the cab 12.

Positioned beneath the cab assembly 11 is a steel beam load 28 secured to the cab 12 via a cable 27. A motor (not shown) within the cab 12 provides a lifting force to the cable 27 and the load 28. This force allows for the upward and downward movement of the load 28 as is shown by the load movement arrow 29. Movement of the load is controlled by operator 36, via the switch 37.

Shown in outline form and designated by arrow 34 is the multiple switch actuating mechanism of the invention. The multiple switch actuating mechanism is held in place by means not detailed in this figure. It is sufficient to note that any suitable clamp or bolt arrangement might be called into use to secure the multiple switch actuating mechanism to any of a number of loations on or within the cab assembly. The only requirement for the location of the multiple switch actuating assembly is that it be readily accessible to an operator who has climbed the ladder 31 and entered the cab 12 and taken his seat 30 for travel with the cab while moving a load 28.

In operation the operator 36 would carry with him the remote control switch unit 37 and secure it to the multiple switch actuating mechanism 34 in the manner to be described more fully with respect to FIG. 2.

Reference is now made to FIG. 2 in which there is depicted the preferred embodiment of the invention shown in three dimensional form. FIG. 2 is made up of a pair of elements shown bracketed. These elements are a remote control switch unit 3 of the type shown in FIG. 1 and a multiple switch actuating mechanism 34 which embodies the invention.

The remote control switch unit 37 is comprised of an elongated body 39 which has secured to end thereof a remote control cable 38 which cable 38 carries electrical wires 25. These wires 25 are connected at one end to motor controls in the cab of FIG. 1 and spring biased open switches of the type shown in FIG. *2b*.

The remote control switch unit 37 is equipped with a plurality of manually depressable switch actuating push buttons in pairs 41 and 42, 43 and 44, 46 and 47. These switch actuating push buttons are normally depressed as in the situation depicted in FIG. 1 by a finger of the operator 36 in order to command a control function for the duration of time the button is depressed. Additional control function push buttons 40 and 45 are also shown in FIG. 2, however, the design of the multiple switch actuating mechanism 34 shown here is not intended to provide for actuation of these additional control function buttons 40 and 45. An on-off switch 48 is also shown as included in the remote control switch unit 37.

In order to readily explain the operation of the invention and explain the cooperative relationship of the machine elements of the multiple switch actuating mechanism 34 and the remote control switch unit, the mechanism 34 and the unit 37 are shown separated. The physical interrelationship of this mechanism 34 and unit 37 can best be understood if the reader of this description will visualize the unit 37 inserted within the mechanism 34 as is indicated by broken line arrows 51 and 52.

The multiple switch actuating mechanism 34 is comprised of an elongated horizontal flat portion 56 which integrally secured at a joint 57 to an elongated vertical flat portion 56 to form an angle shaped member. An end wall 53 is integrally joined to both the horizontal flat portion 56 and vertical flat portion 54 as is shown in FIG. 2. The end wall 53 provides a physical stop for the travel of the remote control switch unit 37 when the unit 37 is inserted in angle shaped portion just described of the multiple switch actuating mechanism 34.

The remote control switch unit 37 is held in position by a pair of clamps 96 and 99 which cooperated with raised shoulder elements 100 and 101 of remote control switch unit 37. Clamp 96 as can be seen has integrally secured thereto a threaded portion 97 which has thereon a wing nut 98 which wing nut 98, threaded portion 97 and clamp 96 provide when the wing nut 98 is tightened a prehensile crasp of the elongated body of the switch unit 37. Though not shown in FIG. 2 clamp 99 is similarly provided with a nut and threaded arrangement to allow clamp 99 to grasp the switch unit body 39.

A plurality of manually operable switch mechanisms 10, 15 and 20 are provided. The details of manually operable switch mechanisms 15 will be described in some detail. The function and operation of switch mechanism 10 and 20 are essentially duplicates of the switch mechanism 15.

The description that follows can best be understood if the partial section illustrations of FIG. 2*a* and FIG. 2*b* are studied in conjunction with the description.

Accordingly manually operable switch mechanism 15 includes an actuating handle 68 secured to a notched handle plate 49 by a weld not referenced. The notched handle plate 49 is secured by welds 78, 79 to a rocker arm 70. The details of the rocker arm 70 and its pivotal connection 59 to vertical flat portion 54 can best be understood if reference is now made to FIG. 2*a* where rocker arm 70 is shown mounted on a bolt 62. The bolt 62 has a head 55 and a threaded portion 63. The vertical flat portion 54 has an opening 61 through which the bolt 62 passes. A tubular spacer 65 is shown sandwiched between vertical flat portion 54 and rocker arm 70. The nut 64 has a hole bored there through which hole is in alignment with a similar hole in bolt 62. These holes are not shown in the drawings. There is shown, however, a cotter pin 66 which passes through the nut 64 and bolt 62. The arrangement just described allows for when assembled the pivotal movement of rocker arm 70 as is shown in FIG. 2 where the actuate movement of arrow 76 is transmitted manually to actuating handle 68.

In a similar fashion manually operable switch mechanism 10 has a handle 67, a notched plate 35 secured to a rocker arm 60. Switch mechanism 20 has a handle 69, notched plate 50 and rocker arm 80. Handle 67 can be moved as is shown by actuate movement arrow 76 as can handle 69 be moved by actuate movement arrow 77.

Attention is now directed to FIG. 2*b* where the details of a switch contact bearing 84 are shown in some detail. The rocker arm 70 of FIG. 2 has secured thereto at either end switch control bearings 83 and 84. These switch contact bearings will respectively come into contact with switch actuating push buttons 43 and 44 of remote control switch unit 37. In a similar fashion rocker arm 60 has switch contact bearings 81, 82 which come in contact with switch actuating push buttons 41 and 42. In like fashion rocker arm 80 has switch contact bearings not referenced for contact with switch actuating push buttons 46 and 47.

The switch contact bearing 84 as shown in FIG. 2*b* is comprised of an outer race 86, a ballbearing 87 and an inner race 85 which has a total width greater than outer race 86. A bolt 88 having a head 89, lock washer 90 passes through the inner race 85 in the fashion shown and is secured by nut 91.

Positioned directly beneath the switch contact bearing 84 is the switch actuating push button 44 noted earlier. In schematic form the switch actuating push button 44 is shown in a biases upward condition by a spring 92. A normally open switch 93 with electrical leads 94 are connected to a controlled unit 95. The controlled unit 95 in practice would be one of the motor controlled crane moving motors mentioned earlier.

Returning now to FIG. 2 it can be seen that actuating handle 67 is disposed at an angle $0_1$ from the vertical axis 71. The actuating handle 68 is coincident with the vertical axis 72 while actuating handle 69 is disposed at an angle $0_2$ from the vertical axis 73. This just described arrangement allows for the unhampered operation of the manually operated switch mechanism 10, 15 and 20.

It should be readily apparent that when an actuating force is removed from any one of the handles 67, 68 or 69, the spring biased condition of push buttons 41, 42, 43, 44, 46 and 47 restore the respective handles to a neutral or nonswitch actuating condition.

The multiple switch actuating mechanism 34 is also provided with a second elongated flat portion 58 integrally secured to the vertical flat portion 54 and to the horizontal flat portion 56 in the plane of the horizontal flat portion 56. This just described arrangement provides a stable base for unit.

Although only a single preferred embodiment of the present invention has been shown and described, it will be apparent to those skilled in the art that various changes and modifications may be made to this embodiment without departing from the spirit of the invention.

What is claimed:

1. A multiple switch actuating mechanism for use in combination with a biased open switch unit, said multiple switch actuating mechanism including (a) an angle shaped member to supportingly receive said biased open switch unit in its entirety, said angle shaped member having an elongated vertical flat portion and at least one elongated horizontal flat portion integrally secured to said elongated vertical flat portion to thereby form said angle shaped member, said biased open switch unit supported in its entirety on said elongated horizontal flat portion, (b) said elongated vertical flat portion having a pivotal means secured at right angles thereto and parallel to said horizontal flat portion, (c) rocker arm means secured to said pivotal means for oscillatory motion in a plane parallel to said elongated vertical flat portion, said rocker arm means having a first and a second rotatably mounted switch contact bearing means secured to said rocker arm means remote from each other, such that said oscillatory motion is transmitted respectively to said rotatably mounted switch contact bearing means, said biased open switch unit positioned between said rocker arm means and said elongated horizontal flat portion, (d) at least one actuating handle for said mechanism secured to said rocker arm, said rotatably mounted switch contact bearing means providing a driving contact with respectively a first and a second biased open switch whereby an oscillatory force applied to said actuating handle causes said oscillatory motion to be transmitted to said first and said second biased open switches to establish unidirectional reciprocating motion to said first and said second biased open switches.

2. The multiple switch actuating mechanism of claim 1 wherein there are provided a plurality of rocker arm means secured in like fashion to said vertical flat portion, each of said rocker arms having an actuating handle and first and second rotatably mounted switch contact bearing means for use in the actuation of a plurality biased open switches positioned between said rocker arm means and said elongated horizontal flat portion.

3. The multiple switch actuating mechanism of claim 2 wherein each of said actuating handles is secured to its respective rocker arm in a plane containing said pivotal means each of said actuating handles positioned at different angles from each other in said plane containing said pivotal means and each of said planes containing said handle and said pivotal means being parallel to each other.

4. The multiple switch actuating means of claim 3 which includes removeable clamp means secured to said elongated vertical flat portion to thereby provide a prehensile crasp of said switch unit.

5. The multiple switch actuating means of claim 4 which includes a second elongated horizontal flat portion in the same plane as said at least one elongated horizontal flat portion, said second elongated horizontal flat portion integrally secured to said elongated vertical flat portion to thereby provide a support base for said multiple switch unit.

* * * * *